US010115333B2

(12) United States Patent
Liu et al.

(10) Patent No.: US 10,115,333 B2
(45) Date of Patent: Oct. 30, 2018

(54) IMAGE DISPLAY METHOD AND DISPLAY APPARATUS

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Peng Liu, Beijing (CN); Xue Dong, Beijing (CN); Renwei Guo, Beijing (CN); Chungchun Chen, Beijing (CN)

(73) Assignees: BOE Technology Group Co., Ltd., Beijing (CN); Beijing BOE Optoelectronics Technology Co., Ltd., Beijing (CN)

( * ) Notice: Subject to any disclaimer, the term of this patent is extended or adjusted under 35 U.S.C. 154(b) by 0 days.

(21) Appl. No.: 15/119,591

(22) PCT Filed: Dec. 11, 2015

(86) PCT No.: PCT/CN2015/097101
§ 371 (c)(1),
(2) Date: Aug. 17, 2016

(87) PCT Pub. No.: WO2016/188094
PCT Pub. Date: Dec. 1, 2016

(65) Prior Publication Data

US 2017/0162102 A1 Jun. 8, 2017

(30) Foreign Application Priority Data

May 22, 2015 (CN) ..... 2015 1 0266853

(51) Int. Cl.
*G09G 3/20* (2006.01)

(52) U.S. Cl.
CPC ... *G09G 3/2074* (2013.01); *G09G 2300/0443* (2013.01); *G09G 2300/0452* (2013.01);
(Continued)

(58) Field of Classification Search
None
See application file for complete search history.

(56) References Cited

U.S. PATENT DOCUMENTS 6,285,804 B1 9/2001 Crinon et al.
8,170,376 B2 5/2012 Matsumoto et al.
(Continued)

FOREIGN PATENT DOCUMENTS

CN 101163224 A 4/2008
CN 101668221 A 3/2010
(Continued)

OTHER PUBLICATIONS

International Search Report of PCT/CN2015/097101 dated Mar. 18, 2016 in Chinese with English translation.
(Continued)

*Primary Examiner* — Ke Xiao
*Assistant Examiner* — Jed-Justin Imperial
(74) *Attorney, Agent, or Firm* — Collard & Roe, P.C.

(57) ABSTRACT

Provided are an image display method and a display apparatus, wherein the method comprises comparing the image within the sampling area with each of the at least one preset characteristic pattern, respectively (101); when the image within the sampling area matches any of the at least one preset characteristic pattern, obtaining a gray scale value for at least one monochromatic sub-pixel among multiple monochromatic sub-pixels corresponding to the sampling area in a value assignment manner corresponding to the preset characteristic pattern, and marking the at least one monochromatic sub-pixel in a state marking matrix as gray
(Continued)

scale value being determined and unchangeable (102); otherwise, calculating gray scale values for multiple monochromatic sub-pixels corresponding to the sampling area according to the markings of the multiple monochromatic sub-pixels corresponding to the sampling area in the state marking matrix and the image within the sampling area, and marking the monochromatic sub-pixels in the state marking matrix as gray scale value being determined and changeable or being processed but gray scale value to be determined (103). The present disclosure can complete an image conversion flow integrated with particular pattern processing in one traversal without repetition or missing.

20 Claims, 9 Drawing Sheets

(52) U.S. Cl.
CPC ..... *G09G 2320/029* (2013.01); *G09G 2340/0457* (2013.01)

(56) References Cited

U.S. PATENT DOCUMENTS

| | | | | |
|---|---|---|---|---|
| 8,405,709 | B2 | 3/2013 | Hirasawa et al. | |
| 2003/0085906 | A1* | 5/2003 | Elliott ..... | G09G 3/20 345/613 |

FOREIGN PATENT DOCUMENTS

| | | | |
|---|---|---|---|
| CN | 103440664 | A | 12/2013 |
| CN | 104183221 | A | 12/2014 |
| CN | 104835440 | A | 8/2015 |
| EP | 1 014 305 | B1 | 9/2004 |

OTHER PUBLICATIONS

Notice of Transmittal of the International Search Report of PCT/CN2015/097101 in Chinese, dated Mar. 18, 2016.

Written Opinion of the International Searching Authority of PCT/CN2015/097101 dated Mar. 18, 2016 in Chinese with English translation.

* cited by examiner

| | | | | | |
|---|---|---|---|---|---|
| 3 | 2 | 2 | 2 | 2 | 2 |
| 3 | 2 | 1 | 0 | 0 | 0 |
| 2 | 2 | 1 | 1 | 0 | 0 |
| 1 | 0 | 0 | 0 | 0 | 0 |

Fig.7

| | | | | | |
|---|---|---|---|---|---|
| 3 | 2 | 2 | 2 | 2 | 2 |
| 3 | 2 | 2 | 1 | 1 | 0 |
| 2 | 2 | 2 | 2 | 1 | 0 |
| 1 | 0 | 0 | 0 | 0 | 0 |

Fig.8

IMAGE DISPLAY METHOD AND DISPLAY APPARATUS

CROSS REFERENCE TO RELATED APPLICATIONS

This application is the National Stage of PCT/CN2015/097101 filed on Dec. 11, 2015, which claims priority under 35 U.S.C. § 119 of Chinese Application No. 201510266053.4 filed on May 22, 2015, the disclosure of which is incorporated by reference.

TECHNICAL FIELD OF THE DISCLOSURE

The present disclosure relates to the art of display technique, and particular to an image display method and a display apparatus.

BACKGROUND

In existing display apparatuses such as LED (Light Emitting Diode) displays, OLED (Organic Light Emitting Diode) displays, PDP (Plasma Display Panel) displays and LCDs (Liquid Crystal Displays), multiple pixels arranged in matrix are usually disposed, wherein each pixel comprises three or four sub-pixels of different colors. Based on such a structure, each sub-pixel is input with a corresponding gray scale signal in one frame such that the pixel can present a certain color to form the displayed image. It can be seen that in the above display apparatuses, the size and pitch of the pixels determine the resolution of the displayed image. However, emergence of high resolution algorithm breaks through the limitation on the image resolution by the physical resolution of the pixels.

A new image processing approach is high resolution algorithm, through which a relatively low physical resolution can be raised to a relatively high virtual resolution for a certain sub-pixel arrangement by taking advantage of the characteristics of human eyes' spatial resolution and in a way such as sub-pixel sharing, whereby not only an optimized display effect but also advantages such as low power consumption and low processing difficulty can be achieved. For example, through a high resolution algorithm, a gray scale value of a sub-pixel at every position can be obtained by appropriately processing the image to be displayed, whereby a high resolution display picture subjected to an image conversion can be obtained.

In existing high resolution algorithms, there is a step for specially processing particular patterns in the image to be displayed. All particular patterns in the image are required to be processed effectively, meanwhile, the relationship between a general processing and a special processing performed on each real pixel needs to be considered, and also the processing of some real pixels also requires referring to previous processing results. Therefore, in a case where algorithm efficiency is considered, it becomes a problem to be solved in the art how to complete an image conversion flow integrated with particular pattern processing in one traversal without repetition or missing.

SUMMARY

In view of the above, the present disclosure provides an image display method and a display apparatus, which can complete an image conversion flow integrated with particular pattern processing in one traversal without repetition or missing.

In a first aspect, the present disclosure provides an image display method comprising sampling an image to be displayed row by row and column by column in a predefined order by using a rectangular sampling area with a size matching at least one preset characteristic pattern, wherein after obtaining an image within a sampling area, the method further comprises:

comparing the image within the sampling area with each of the at least one preset characteristic pattern, respectively;

in a case where the image within the sampling area matches any of the at least one preset characteristic pattern, obtaining a gray scale value for at least one monochromatic sub-pixel among multiple monochromatic sub-pixels corresponding to the sampling area in a value assignment manner corresponding to the preset characteristic pattern, and marking the at least one monochromatic sub-pixel in a state marking matrix as gray scale value being determined and unchangeable; and in a case where the image within the sampling area does not match any of the at least one present characteristic pattern, calculating gray scale values for multiple monochromatic sub-pixels corresponding to the sampling area according to the markings of the multiple monochromatic sub-pixels corresponding to the sampling area in the state marking matrix and the image within the sampling area, and marking the monochromatic sub-pixels in the state marking matrix as gray scale value being determined and changeable or being processed but gray scale value to be determined;

wherein all the markings in the state marking matrix correspond to all the monochromatic sub-pixels for displaying the image in a one to one manner, and in an initial state, all the markings in the state marking matrix, which correspond to all the monochromatic sub-pixels, are unprocessed.

Optionally, the method further comprises:

detecting current processing progress and/or errors that have occurred according to the markings in the state marking matrix.

Optionally, any monochromatic sub-pixel is used to form displaying of one or two pixels in the image to be displayed; and said in a case where the image within the sampling area does not match any of the at least one present characteristic pattern, calculating gray scale values for multiple monochromatic sub-pixels corresponding to the sampling area according to the markings of the multiple monochromatic sub-pixels corresponding to the sampling area in the state marking matrix and the image within the sampling area, and marking the monochromatic sub-pixels with the gray scale values obtained in the state marking matrix as gray scale value being determined and changeable or marking the monochromatic sub-pixels without obtaining the gray scale values as being processed but gray scale value to be determined, comprises:

acquiring sequentially the markings in the state marking matrix for the multiple monochromatic sub-pixels corresponding to the sampling area;

in a case where any monochromatic sub-pixel is marked as gray scale value being determined and unchangeable or gray scale value being determined and changeable, skipping processing the monochromatic sub-pixel;

in a case where any monochromatic sub-pixel is marked as being processed but gray scale value to be determined, calculating the gray scale value for the monochromatic sub-pixel according to the image within the sampling area, and marking the monochromatic sub-pixel in the state marking matrix as gray scale value being determined and changeable; and in a case where any monochromatic sub-pixel is marked as being unprocessed, marking the monochromatic sub-pixel in the state marking matrix as being processed but gray scale value to be determined;

wherein before said acquiring sequentially the markings in the state marking matrix for the multiple monochromatic sub-pixels corresponding to the sampling area, at least one monochromatic sub-pixel on an edge in the state marking matrix is marked as being processed but gray scale value to be determined.

Optionally, all the monochromatic sub-pixels for displaying are arranged with a repeating group as the smallest repeating unit, each repeating group comprising M pixel groups, and each of the M pixel groups comprising monochromatic sub-pixels, one for each color, and each repeating group corresponding to N pixels in the image to be displayed, wherein M is smaller than N, and M and N are both larger than zero.

Optionally, said in a case where the image within the sampling area matches any of the at least one preset characteristic pattern, obtaining a gray scale value for at least one monochromatic sub-pixel among multiple monochromatic sub-pixels corresponding to the sampling area in a value assignment manner corresponding to the preset characteristic pattern, and marking the at least one monochromatic sub-pixel in a state marking matrix as gray scale value being determined and unchangeable, comprises:

determining at least one pixel group for displaying the preset characteristic pattern according to a position of the sampling area in the image; and obtaining a gray scale value for at least one monochromatic sub-pixel among multiple monochromatic sub-pixels corresponding to the sampling area in a value assignment manner corresponding to the preset characteristic pattern, and marking the at least one monochromatic sub-pixel in a state marking matrix as gray scale value being determined and unchangeable.

Optionally, all the monochromatic sub-pixels for displaying the image comprise first sub-pixels, second sub-pixels and third sub-pixels; each repeating groups comprises two first sub-pixels, two second sub-pixels and two third sub-pixels; a first sub-pixel, a second sub-pixel and a third sub-pixel in a first pixel row of each repeating groups are arranged in sequence; a third sub-pixel, a first sub-pixel and a second sub-pixel in a second pixel row of each repeating groups are arranged in sequence; except the monochromatic sub-pixels located at an edge position, any three of adjacent first sub-pixel, second sub-pixel and third sub-pixel forms displaying of two adjacent pixels in the same row of the image.

Optionally, the preset characteristic pattern comprises a vertical line pattern, a left slash pattern and a right slash pattern each occupying two adjacent upper and lower rows of pixels and three adjacent left, middle and right columns of pixels in the image;

both middle-upper pixels and the middle-lower pixels of the vertical line pattern are in a first gray scale state, all the other pixels thereof are in a second gray scale state, the first gray scale state and the second grays scale state being one of a bright state and a dark state respectively;

both left-lower pixels and middle-upper pixels of the left slash pattern are in the first gray scale state, all the other pixels thereof are in the second gray scale state; and both right-lower pixels and middle-upper pixels of the right slash pattern are in the first gray scale state, all the other pixels thereof are in the second gray scale state.

In a second aspect, the present disclosure also provides a display apparatus, comprising:

a sampling module configured to sample an image to be displayed row by row and column by column in a predefined order by using a rectangular sampling area with a size matching at least one preset characteristic pattern;

a comparing module configured to compare an image within a sampling area with each of the at least one preset characteristic pattern respectively after the sampling module obtains an image within a sampling area;

a first processing module configured to, in a case where the comparing module determines that the image within the sampling area matches any of the at least one preset characteristic pattern, obtain a gray scale value for at least one monochromatic sub-pixel among multiple monochromatic sub-pixels corresponding to the sampling area in a value assignment manner corresponding to the preset characteristic pattern, and mark the at least one monochromatic sub-pixel in a state marking matrix as gray scale value being determined and unchangeable; and a second processing module configured to, in a case where the comparing module determines that the image within the sampling area does not match any of the at least one present characteristic pattern, calculate gray scale values for multiple monochromatic sub-pixels corresponding to the sampling area according to the markings of the multiple monochromatic sub-pixels corresponding to the sampling area in the state marking matrix and the image within the sampling area, and mark the monochromatic sub-pixels in the state marking matrix as gray scale value being determined and changeable or being processed but gray scale value to be determined;

wherein all the markings in the state marking matrix correspond to all the monochromatic sub-pixels for displaying the image in a one to one manner, and in an initial state, all the markings in the state marking matrix, which correspond to all the monochromatic sub-pixels, are unprocessed.

Optionally, the apparatus further comprises:

a detecting module configured to detect current processing progress and/or errors that have occurred according to the markings in the state marking matrix.

Optionally, any monochromatic sub-pixel is used to form displaying of one or two pixels in the image to be displayed, and the second processing module comprises:

an acquiring unit configured to acquire sequentially the markings in the state marking matrix for the multiple monochromatic sub-pixels corresponding to the sampling area;

a first processing unit configured to, in a case where the acquiring unit determines that any monochromatic sub-pixel is marked as gray scale value being determined and unchangeable or gray scale value being determined and changeable, skip processing the monochromatic sub-pixel;

a second processing unit configured to, in a case where the acquiring unit determines that any monochromatic sub-pixel is marked as being unprocessed, mark the monochromatic sub-pixel in the state marking matrix as being processed but gray scale value to be determined; and a third processing unit configured to, in a case where the acquiring unit determines that any monochromatic sub-pixel is marked as being processed but gray scale value to be determined, calculate the gray scale value for the monochromatic sub-pixel according to the image within the sampling area, and mark the monochromatic sub-pixel in the state marking matrix as gray scale value being determined and changeable;

wherein before said acquiring sequentially the markings in the state marking matrix for the multiple monochromatic sub-pixels corresponding to the sampling area, at least one monochromatic sub-pixel on an edge in the state marking matrix is marked as being processed but gray scale value to be determined.

Optionally, all the monochromatic sub-pixels for displaying are arranged with a repeating group as the smallest repeating unit, each repeating group comprising M pixel groups, and each of the M pixel groups comprising monochromatic sub-pixels, one for each color, and each repeating group corresponding to N pixels in the image to be displayed, wherein M is smaller than N, and M and N are both larger than zero.

Optionally, the first processing module comprises:

a first determining unit configured to, in a case where the comparing module determines that the image within the sampling area matches any of the at least one preset characteristic pattern, determine at least one pixel group for displaying the preset characteristic pattern according to a position of the sampling area in the image; and a fourth processing unit configured to obtain a gray scale value for at least one monochromatic sub-pixel among all the monochromatic sub-pixels in at least one pixel group obtained by the first determining unit in a value assignment manner corresponding to the preset characteristic pattern, and mark the at least one monochromatic sub-pixel in a state marking matrix as gray scale value being determined and unchangeable.

Optionally, all the monochromatic sub-pixels for displaying the image comprise first sub-pixels, second sub-pixels and third sub-pixels; each repeating groups comprises two first sub-pixels, two second sub-pixels and two third sub-pixels; a first sub-pixel, a second sub-pixel and a third sub-pixel in a first pixel row of each repeating groups are arranged in sequence; a third sub-pixel, a first sub-pixel and a second sub-pixel in a second pixel row of each repeating groups are arranged in sequence; except the monochromatic sub-pixels located at an edge position, any three of adjacent first sub-pixel, second sub-pixel and third sub-pixel forms displaying of two adjacent pixels in the same row of the image.

Optionally, the preset characteristic pattern comprises a vertical line pattern, a left slash pattern and a right slash pattern each occupying two adjacent upper and lower rows of pixels and three adjacent left, middle and right columns of pixels in the image;

both middle-upper pixels and the middle-lower pixels of the vertical line pattern are in a first gray scale state, all the other pixels thereof are in a second gray scale state, the first gray scale state and the second grays scale state being one of a bright state and a dark state respectively;

both left-lower pixels and middle-upper pixels of the left slash pattern are in the first gray scale state, all the other pixels thereof are in the second gray scale state; and both right-lower pixels and middle-upper pixels of the right slash pattern are in the first gray scale state, all the other pixels thereof are in the second gray scale state.

From the above technical solutions, the present disclosure can obtain the gray scale values of all the monochromatic sub-pixels for displaying an image to be displayed in one sampling traversal process on the image to be displayed, combining special processing for preset characteristic patterns at the same time. In addition, because some monochromatic sub-pixels corresponding to the preset characteristic pattern, with gray scale values being determined and unchangeable, are marked specially in the state marking matrix, it can be ensured that the processing on these monochromatic sub-pixels will not be repeated or missed during the process and will not be changed during the subsequent process, whereby an image conversion flow integrated with particular image processing can be completed in one traversal without repetition or missing.

Further, since the monochromatic sub-pixel in an embodiment of the present disclosure can be used for displaying multiple image pixels simultaneously, the present disclosure can be applied to various types of pixel structures, and can realize a high resolution algorithm with high algorithm efficiency under the precondition of combining particular pattern processing.

BRIEF DESCRIPTION OF THE DRAWINGS

In order to describe the technical solutions in embodiments of the present disclosure and the known solutions in more details, the FIGS. to be used in the description on the embodiments and known solutions will be briefly introduced in the following. Obviously, the FIGS. in the following description are only some embodiments of the present disclosure. Those skilled in the art can obtain other FIGS. based on these FIGS. without creative work.

FIG. 7 is a schematic diagram of a state marking matrix in one embodiment of the present disclosure;

FIG. 8 is a schematic diagram of change of the state marking matrix as shown in FIG. 7 after one time of sampling is completed;

DETAILED DESCRIPTION

Figure 1:
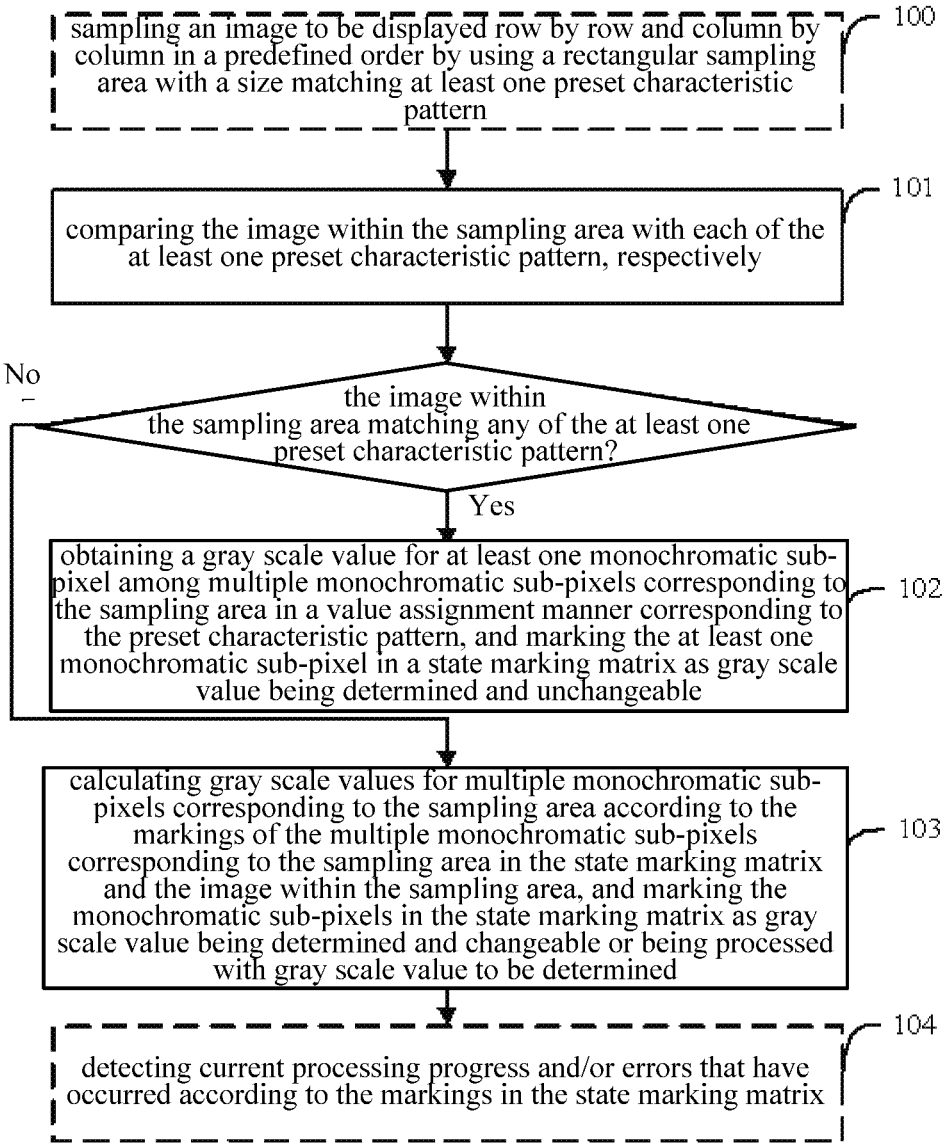
FIG. 1 is a schematic flowchart of a part of steps of an image display method in one embodiment of the present disclosure.

In order to make objects, technical solutions and advantages of embodiments of the present disclosure clearer, in the following, clear and complete description will be made on technical solutions in embodiments of the present disclosure in combination with the FIGS. in the embodiments of the present disclosure. Obviously, the described embodiments are only part embodiments of the present disclosure, rather than all the embodiments. All other embodiments obtained by those skilled in the art based on the embodiments of the present disclosure without creative work fall in the scope of the present disclosure.

An embodiment of the present disclosure provides an image display method. It should be noted that the image display method can comprise all the procedures for completing displaying an image, but embodiments of the present disclosure mainly describe a processing procedure for obtaining gray scale values for all the monochromatic sub-pixels for displaying an image to be displayed based on the image. The other steps which can be comprised in the above image display method can be implemented by those skilled in the art, which will not be repeated herein.

In addition, for at least one type of preset characteristic pattern that may exist in the image to be displayed, it is required to perform special processing in a value assignment manner corresponding to the preset characteristic pattern. It should be appreciated that the image to be displayed, the structure and arrangement of the monochromatic sub-pixels, the preset characteristic pattern and the value assignment manner corresponding to the present characteristic pattern are all determined according to specific application scenarios, which are not limited by the present disclosure.

The above image display method comprises a step 100 of sampling an image to be displayed row by row and column by column in a predefined order by using a rectangular sampling area with a size matching at least one preset characteristic pattern. For example, for at least one preset characteristic pattern with the same size, the sampling area can also have the same size; for the preset characteristic patterns with different sizes, the sampling area can have the same size with the largest preset characteristic pattern in order to ensure that any of preset characteristic pattern can be detected in one sampling area. The implementation of sampling the image row by row and column by column can ensure that no preset characteristic pattern in the image is missed. For example, for an image with a size of 10 rows by 10 columns and a sampling area with a size of 2×2, whether a preset characteristic pattern exists in the first and second rows of the image can be determined after sampling with the 2×2 sampling area for 9 times, and whether a preset characteristic pattern exists in the second and third rows of the image can be determined after sampling with the 2×2 sampling area for further 9 times, and so on. It is required to sample with the 2×2 sampling area row by row and column by column for 81 times to determine whether a preset characteristic pattern exists in the whole image. Of course, the sampling order in step 100 can be set by those skilled in the art according to the application scenarios, which will not be limited by the present disclosure.

FIG. 1 is a schematic flowchart of a part of steps in an image display method in one embodiment of the present disclosure. Referring to FIG. 1, after obtaining an image within the sampling area at each position, the above method further comprises:

a step 101, comparing the image within the sampling area with each of the above at least one preset characteristic pattern, respectively (in a case where the sizes are identical, comparison can be performed direct, while in a case where the sizes are different, a scanning comparison can be performed within the sampling area row by row and column by column);

a step 102, in a case where the image within the sampling area matches any of the above preset characteristic patterns, obtaining a gray scale value for at least one monochromatic sub-pixel among multiple monochromatic sub-pixels corresponding to the sampling area in a value assignment manner corresponding to the preset characteristic pattern, and marking the at least one monochromatic sub-pixel in a state marking matrix as gray scale value being determined and unchangeable; and a step 103, in a case where the image within the sampling area does not match any of the above present characteristic patterns, calculating gray scale values for multiple monochromatic sub-pixels corresponding to the sampling area according to the markings of the multiple monochromatic sub-pixels corresponding to the sampling area in the state marking matrix and the image within the sampling area, and marking the monochromatic sub-pixels in the state marking matrix as gray scale value being determined and changeable or being processed but gray scale value to be determined;

wherein all the markings in the state marking matrix correspond to all the monochromatic sub-pixels for displaying the image in a one to one manner, the involved markings having four types of "unprocessed", "processed but gray scale value to be determined", "gray scale value determined and changeable", and "gray scale value determined and unchangeable", in an initial state (that is, before the above step 100), all the markings in the state marking matrix, which correspond to all the monochromatic sub-pixels, are unprocessed, wherein the "gray scale value determined and unchangeable" indicates that a corresponding gray scale value cannot be changed in subsequent processes, and then after a gray scale value for the monochromatic sub-pixel is obtained, the processing for the monochromatic sub-pixel can be skipped in the subsequent processes in order to ensure that the obtained gray scale value will not be overwritten by other values; correspondingly, the other three markings indicates that the corresponding gray scale value can be changed in the subsequent processes.

It can be seen that the embodiments of the present disclosure can obtain the gray scale values for all the monochromatic sub-pixels for displaying an image to be displayed in one sampling traversal process on the image to be displayed, combining special processing for preset characteristic patterns at the same time. In addition, because some monochromatic sub-pixels corresponding to the preset characteristic pattern, with gray scale values determined and unchangeable, are marked specially in the state marking matrix, it can be ensured that the processing on these monochromatic sub-pixels will not be repeated or missed during the process and will not be changed during the subsequent process, whereby an image conversion flow integrated with particular image processing can be completed in one traversal without repetition or missing.

Further, since the monochromatic sub-pixel in an embodiment of the present disclosure can be used for displaying multiple image pixels simultaneously, the present disclosure can be applied to various types of pixel structures, and can implement a high resolution algorithm with high algorithm efficiency under a precondition of integrated with the particular pattern processing.

In one embodiment of the present disclosure, the above method can further comprise a step 104 as shown in a dashed block, detecting current processing progress and/or errors that have occurred according to the markings in the state marking matrix. It can be understood that the state marking matrix contains processing states for each monochromatic sub-pixel. Therefore, by referring to the markings in the state marking matrix, current processing progress can be detected (for example, can be implemented by detecting the marking indicating the state of being unprocessed) and/or errors that have occurred can be detected (by detecting whether the arrangement of the markings is compliant with the arrangement rule under a normal processing, for example, a marking indicating "being unprocessed" occurring alone in the center of an area is obviously incompliant with the arrangement rule under the normal processing, and belongs to an error that has occurred).

Figure 3A:
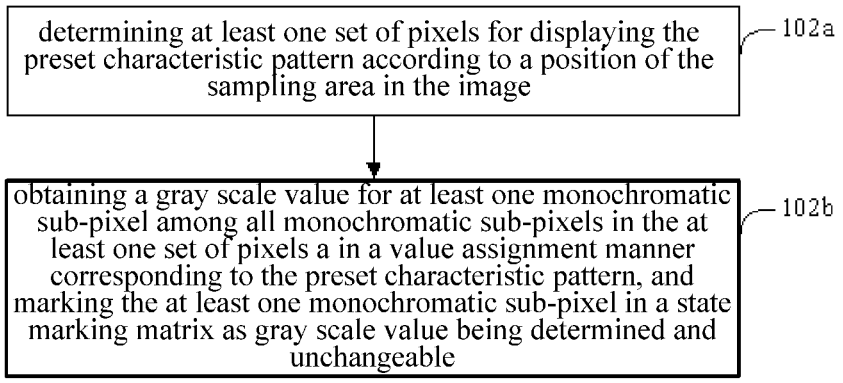
FIGS. 3A-3B are schematic flowcharts of a part of processing steps in an image display method in one embodiment of the present disclosure.

In one embodiment of the present disclosure, all the monochromatic sub-pixels for displaying are arranged with a repeating group as the smallest repeating unit, each repeating group comprising M pixel groups, and each of the M pixel groups comprising monochromatic sub-pixels, one for each color, and each repeating group corresponding to N pixels in the image to be displayed, wherein M is smaller than N, and M and N are both larger than zero. It should be noted that any one monochromatic sub-pixel is only comprised in one pixel group, rather than being shared by two pixel groups. It can be seen that one monochromatic sub-pixel in embodiments of the present disclosure can be used for displaying multiple pixels in the image simultaneously, and therefore, compared with being used only for displaying one pixel in the image, a higher display resolution can be achieved. In an embodiment of the present disclosure, the above step 102 of "in a case where the image within the sampling area matches any of the above preset characteristic patterns, obtaining a gray scale value for at least one monochromatic sub-pixel among multiple monochromatic sub-pixels corresponding to the sampling area in a value assignment manner corresponding to the preset characteristic pattern, and marking the at least one monochromatic sub-pixel in a state marking matrix as gray scale value being determined and unchangeable" can comprise the following steps as shown in FIG. 3A:

a step 102*a*, determining at least one pixel group for displaying the preset characteristic pattern according to a position of the sampling area in the image; and a step 102*b*, obtaining a gray scale value for at least one monochromatic sub-pixel among multiple monochromatic sub-pixels within the at least one pixel group in a value assignment manner corresponding to the preset characteristic pattern, and marking the at least one monochromatic sub-pixel in a state marking matrix as gray scale value being determined and unchangeable.

In other words, for all the monochromatic sub-pixels which may be influenced by the preset characteristic pattern, the gray scale values are set in a corresponding value assignment manner, to ensure an effective processing on the preset characteristic pattern in the image during the displaying process.

On the other hand, because one monochromatic sub-pixel (taking a monochromatic sub-pixel Px as example) in an embodiment of the present disclosure can be used for displaying multiple pixels in the image (taking pixels P1, P2, P3 in the image as examples) simultaneously, in the above step 103, a gray scale value for the monochromatic sub-pixel Px cannot be determined until at least the sampling for the three pixels of P1, P2 and P3 in the image has been completed. Therefore, in the above step 103, during a process for calculating the gray scale value for the monochromatic sub-pixel Px, there may be the following two cases for the Px which is not marked as gray scale value being determined and unchangeable:

in a first case, the sampling for the three pixels of P1, P2 and P3 in the image has been completed, based on which, in step 103, the gray scale value for the monochromatic sub-pixel Px can then be calculated (for example, in a case where the Px is a red sub-pixel, the gray scale value of the Px can taken as an average of respective red channel components of the three pixels of P1, P2 and P3); since the gray scale value of Px has been obtained, in the above state marking matrix, the monochromatic sub-pixel Px can be marked as gray scale value being determined and changeable; and in a second case, the sampling for the three pixels of P1, P2 and P3 in the image is not completed, causing that, in step 103, the gray scale value of the monochromatic sub-pixel Px cannot be calculated, but need to be calculated in a subsequent process, and therefore, in step 103, the monochromatic sub-pixel Px can be marked in the above state marking matrix as being processed but gray scale value to be determined.

Thus, an embodiment of the present disclosure can obtain a gray scale value for each monochromatic sub-pixel in a case where no preset characteristic pattern is matched. At the same time, through referring to the markings in the state marking matrix, the monochromatic sub-pixels with gray scale value being determined and unchangeable will not be influenced.

In combination with the above examples, it can be understood by those skilled in the art that, with respect to the "marking the monochromatic sub-pixels in the state marking matrix as gray scale value being determined and changeable or being processed but gray scale value to be determined" in the above step 103, it needs to determine how to mark according to whether a calculated result of the gray scale value can be obtained.

Figure 2:
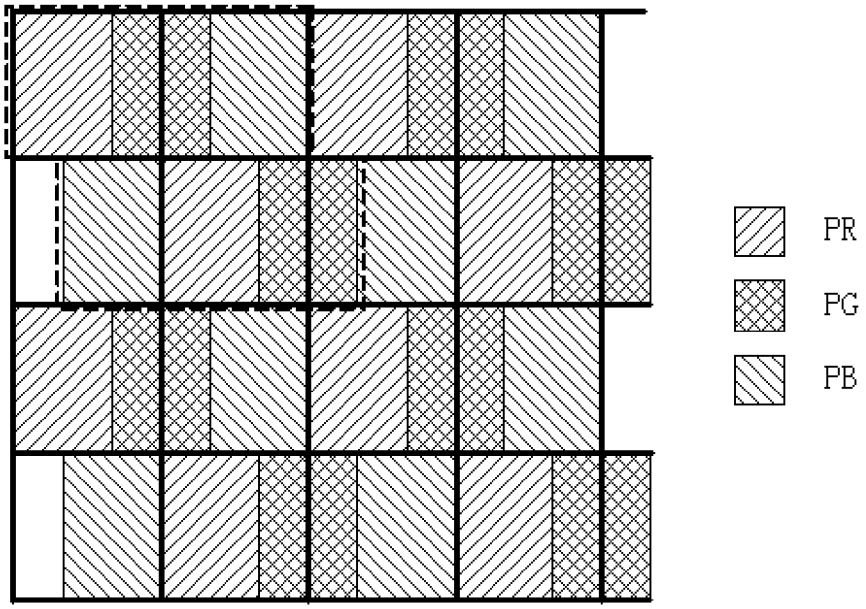
FIG. 2 is a schematic structural diagram of a pixel structure in one embodiment of the present disclosure.

As an example, FIG. 2 is a schematic structural diagram of a pixel structure in one embodiment of the present disclosure. Referring to FIG. 2, all the above monochromatic sub-pixels for displaying the image comprise three types of monochromatic sub-pixels, i.e. first sub-pixels PR, second sub-pixels PG and third sub-pixels PB. Each of the above repeating groups (as shown by areas denoted by dashed frames in FIG. 2) comprises two first sub-pixels PR, two second sub-pixels PG and two third sub-pixels PB, wherein a first sub-pixel PR, a second sub-pixel PG and a third sub-pixel PB in a first pixel row of each of the repeating groups are arranged in order, and a third sub-pixel PB, a first sub-pixel PR and a second sub-pixel PG in a second pixel row of each of the repeating groups are arranged in order. It can be understood that the first sub-pixels PR, the second sub-pixels PG and the third sub-pixels PB are all one type of monochromatic sub-pixels, and one pixel group in embodiments of the present disclosure comprises one first sub-pixel PR, one second sub-pixel PG and one third sub-pixel PB, and one repeating group comprises two pixel groups. With such a structure, except the monochromatic sub-pixels located at an edge position, any three adjacent first sub-pixel PR, second sub-pixel PG and third sub-pixel PB are used to form displaying of two adjacent pixels in the same row of the image.

For example, the pixel arrangement in the image to be displayed is shown by the square blocks denoted by black thick lines in FIG. 2, wherein the monochromatic sub-pixels within and adjacent to a square block form displaying of a pixel represented by the square block. For ease of description, the pixels in the top most row in FIG. 2 are referred to the first row of pixels, and the pixels in the left most column are referred to as the first column of pixels. For example, the PR, PG and PB within the dashed frame in the first pixel row can form displaying of the pixels in the first row and the first column, while the PG and PB among them can be not only used to form displaying of the pixels in the first row and the first column, but also used to form displaying of the pixels in the first row and the second column. The monochromatic sub-pixels for forming displaying of the pixels in the second row and the second column comprise, in addition to the above PG and PB, a PR to the right of the PB in the same pixel row. By parity of reasoning, in the first pixel row, except the PR within the dashed frame, every monochromatic sub-pixel is used to form displaying of two adjacent columns of pixels in the first row simultaneously. Put the other way round, in the first row, except the first column of pixel, displaying of other columns of pixels is formed by the monochromatic sub-pixels within the square block and two monochromatic sub-pixels adjacent to the monochromatic sub-pixel on the right side and on the left side, the same for other rows of pixels.

As can be seen, in an embodiment of the present disclosure, each repeating group comprises 2 pixel groups, and each repeating group corresponds to 4 pixels in the image to be displayed. Therefore, in the embodiment of the present disclosure, M=2 and N=4.

Based on the above structure, an embodiment of the present disclosure can implement a sharing for monochromatic sub-pixels between adjacent pixels, and can reduce half data lines with the same resolution.

Figure 3B:
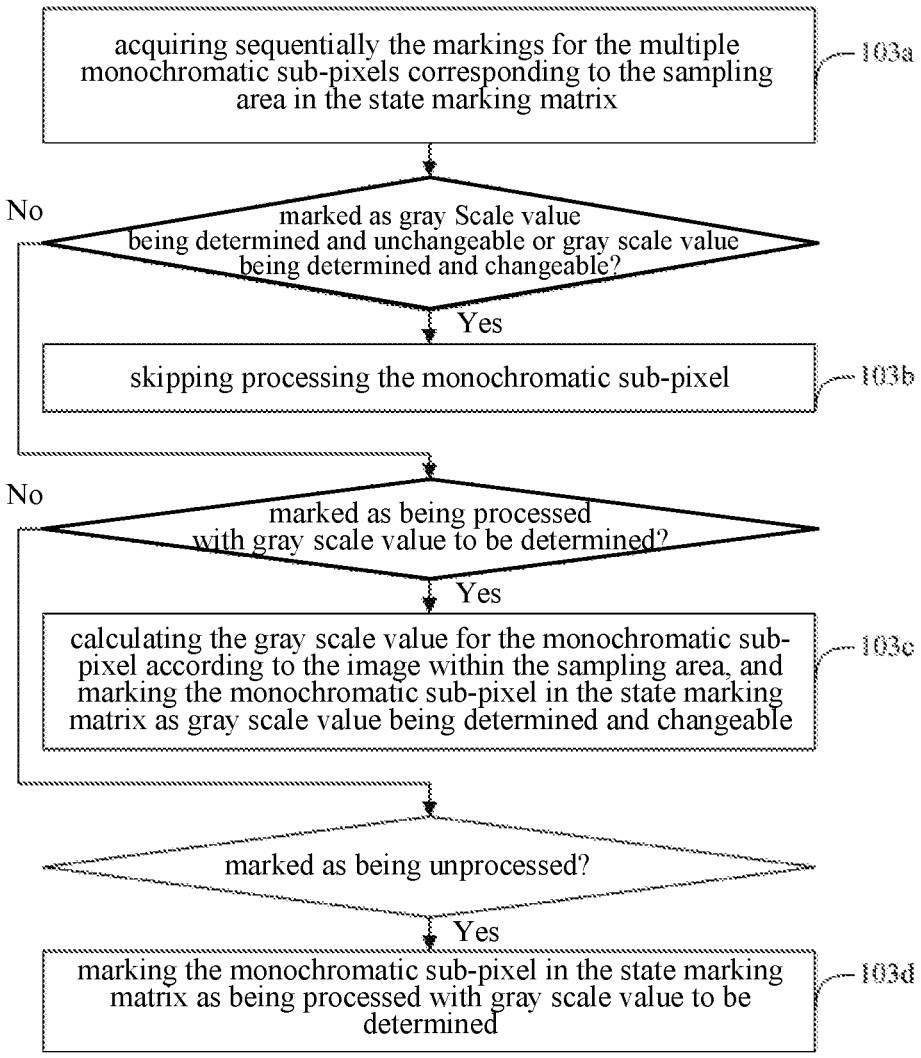

Based on the pixel structure as shown in FIG. 2, it can be seen that any monochromatic sub-pixel at an edge position is used to form displaying of one pixel in the above image to be displayed, and any monochromatic sub-pixel which is not at an edge position is used to form displaying of two pixels in the above image to be displayed. Based on any type of pixel structure, any of the above monochromatic sub-pixels form displaying of one or two pixels in the image to be displayed, the above step 103 of "in a case where the image within the sampling area does not match any of the above present characteristic patterns, calculating gray scale values for multiple monochromatic sub-pixels corresponding to the sampling area according to the markings of the multiple monochromatic sub-pixels corresponding to the sampling area in the state marking matrix and the image within the sampling area, and marking the monochromatic sub-pixels in the state marking matrix as gray scale value being determined and changeable or being processed but gray scale value to be determined" can comprise the following steps as shown in FIG. 3B:

a step 103*a*, acquiring sequentially the markings in the state marking matrix for the multiple monochromatic sub-pixels corresponding to the sampling area;

a step 103*b*, in a case where any monochromatic sub-pixel is marked as gray scale value being determined and unchangeable or gray scale value being determined and changeable, skipping processing the monochromatic sub-pixel;

a step 103*c*, in a case where any monochromatic sub-pixel is marked as being processed but gray scale value to be determined, calculating the gray scale value for the monochromatic sub-pixel according to the image within the sampling area, and marking the monochromatic sub-pixel in the state marking matrix as gray scale value being determined and changeable; and a step 103*d*, in a case where any monochromatic sub-pixel is marked as being unprocessed, marking the monochromatic sub-pixel in the state marking matrix as being processed but gray scale value to be determined;

wherein before said acquiring sequentially the markings in the state marking matrix for the multiple monochromatic sub-pixels corresponding to the sampling area, at least one monochromatic sub-pixel on an edge in the state marking matrix is marked as being processed but gray scale value to be determined.

It should be noted that the performing order of step 103*b*, step 103*c* and step 103*d* as shown in FIG. 3B is only an example. In practice, one of the three steps can be selected to perform according to the acquired result of step 103*a*, without needing to perform determination for several times.

In any of the above step flows, all the above preset characteristic patterns can comprise a vertical line pattern, a left slash pattern and a right slash pattern each occupying two adjacent upper and lower rows of pixels and three adjacent left, middle and right columns of pixels in the image;

both middle-upper pixels and the middle-lower pixels of the vertical line pattern are in a first gray scale state, all the other pixels thereof are in a second gray scale state, the first gray scale state and the second grays scale state being one of a bright state and a dark state respectively;

both left-lower pixels and middle-upper pixels of the left slash pattern are in the first gray scale state, all the other pixels thereof are in the second gray scale state; and both right-lower pixels and middle-upper pixels of the right slash pattern are in the first gray scale state, all the other pixels of the right slash pattern are in the second gray scale state.

It should be noted that, for ease of description, the above two rows of pixels are referred herein as two upper and lower rows of pixels, and the above three columns of pixels are referred as three left, middle and right columns of pixels, such that the six pixels within the preset characteristic patterns with the same size can be referred to as a left-upper pixel, a left-lower pixel, a middle-upper pixel, a middle-lower pixel, a right-upper pixel and a right-lower pixel, respectively.

Step 100, step 101, step 102*a*-step 102*b* and step 103*a* to step 103*d* in the above method will be described in detail below taking the pixel structure shown in FIG. 2 as an example and in connection with the above several preset characteristic patterns and their corresponding value assignment manners.

Figure 4A:
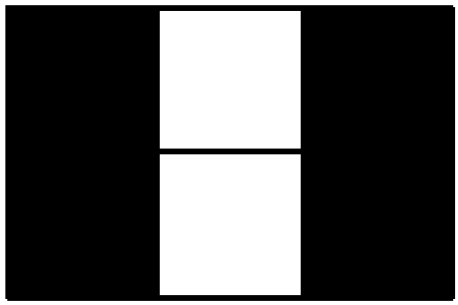
FIG. 4A is a schematic diagram of a vertical line pattern in one embodiment of the present disclosure.

FIG. 4A is a schematic diagram of a vertical line pattern in one embodiment of the present disclosure. Referring to FIG. 4A, the vertical line pattern comprises pixels in two rows and three columns in the image, wherein the middle column of pixels are displayed in the bright state, and the left column of pixels and the right column of pixels are displayed in the dark state.

Figure 4B:
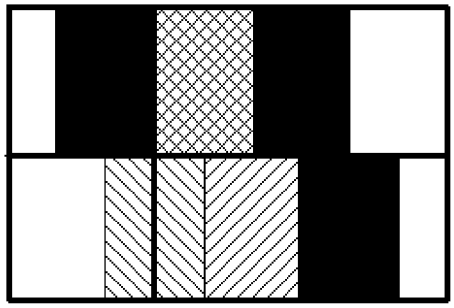
FIG. 4B and FIG. 4C are schematic diagrams of value assignment manners corresponding to the vertical line pattern as shown in FIG. 4A.
Figure 4C:
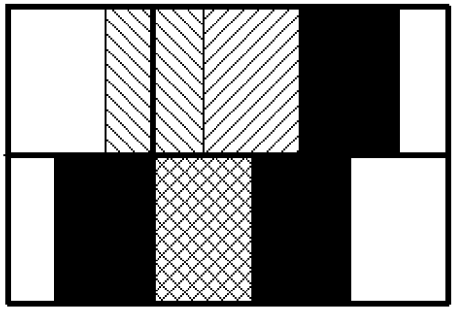

Accordingly, with the pixel structure as shown in FIG. 2, the value assignment manners corresponding to the preset characteristic pattern are shown in FIG. 4B and FIG. 4C. Depending on different positions of the preset characteristic pattern, its corresponding monochromatic sub-pixel can have a gray scale value assignment manner as shown in FIG. 4B or FIG. 4C. In FIG. 4B and FIG. 4C, the three monochromatic sub-pixels in the upper row are used to form displaying of the middle-upper pixel, and the three monochromatic sub-pixels in the lower row are used to form display of the middle-lower pixel. In FIG. 4B, the gray sale values for the first sub-pixel PR and the third sub-pixel PB in the upper row and the second sub-pixel PG in the lower row are set as close to the minimum value (being black in the dark state when being displayed); the gray sale values for the second sub-pixel PG in the upper row and the first sub-pixel PR and the third sub-pixel PB in the lower row are set as close to the maximum value (being red, green or blue in the bright state when being displayed). In FIG. 4C, the gray sale values of the second sub-pixel PG in the upper row and the first sub-pixel PR and the third sub-pixel PB in the lower row are set as close to the minimum value (being black in the dark state when being displayed); the gray sale values of the first sub-pixel PR and the third sub-pixel PB in the upper row and the second sub-pixel PG in the lower row are set as close to the maximum value (being red, green or blue in the bright state when being displayed). In embodiments of the present disclosure, those skilled in the art can easily determine whether to use the value assignment manner as shown in FIG. 4B or FIG. 4C for the preset characteristic pattern as shown in FIG. 4A at any position, which will not be repeated herein.

Figure 5A:
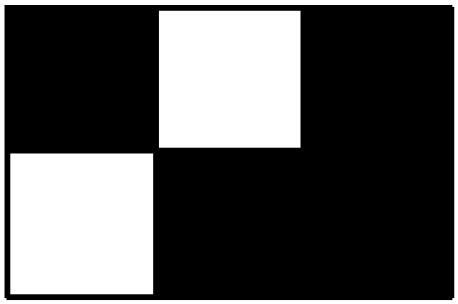
FIG. 5A is a schematic diagram of a left slash pattern in one embodiment of the present disclosure.
Figure 5B:
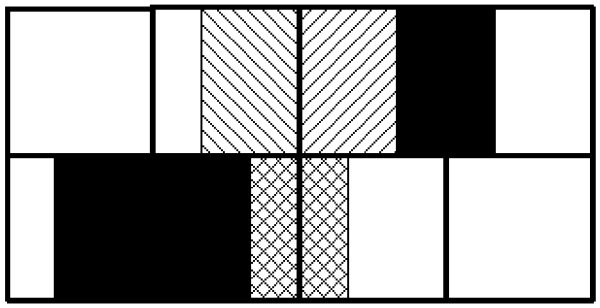
FIG. 5B and FIG. 5C are schematic diagrams of value assignment manners corresponding to the left slash pattern as shown in FIG. 5A.
Figure 5C:
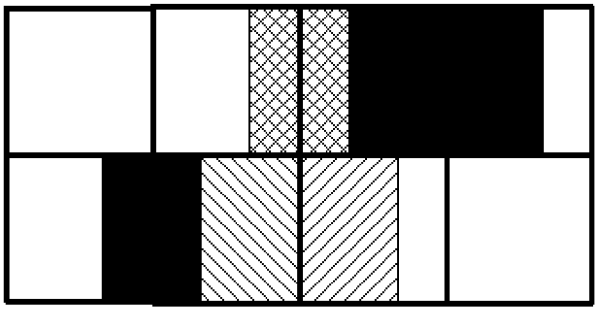

Similarly, FIG. 5A is a schematic diagram of a left slash pattern in one embodiment of the present disclosure. In the preset characteristic pattern, the middle-upper pixel and the left-lower pixel are in the bright state, and all the other pixels are in the dark state. Depending on different positions of the preset characteristic pattern, its corresponding monochromatic sub-pixel can have a gray scale value assignment manner as shown in FIG. 5B or FIG. 5C. In FIG. 5B and FIG. 5C, the three monochromatic sub-pixels in the upper row are used to form displaying of the middle-upper pixel, and the three monochromatic sub-pixels in the lower row are used to form display of the left-lower pixel. In FIG. 5B, the gray sale values of the third sub-pixel PB and the first sub-pixel PR in the upper row and the second sub-pixel PG in the lower row are set as close to the maximum value (being red, green or blue in the bright state when being displayed); the gray sale values of the second sub-pixel PG in the upper row and the third sub-pixel PB and the first sub-pixel PR in the lower row are set as close to the minimum value (being black in the dark state when being displayed). In FIG. 5C, the gray sale values of the second sub-pixel PG in the upper row and the third sub-pixel PB and the first sub-pixel PR in the lower row are set as close to the maximum value (being red, green or blue in the bright state when being displayed); the gray sale values of the third sub-pixel PB and the first sub-pixel PR in the upper row and the second sub-pixel PG in the lower row are set as close to the minimum value (being black in the dark state when being displayed).

Figure 6A:
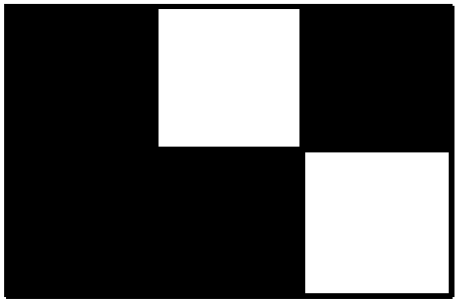
FIG. 6A is a schematic diagram of a right slash pattern in one embodiment of the present disclosure.
Figure 6B:
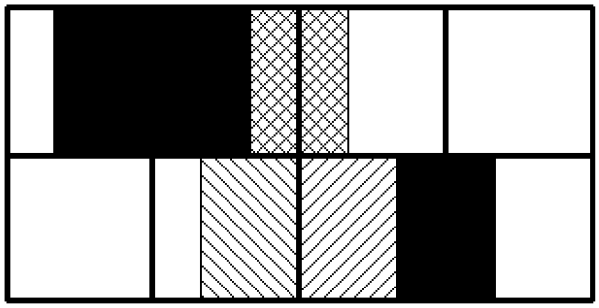
FIG. 6B and FIG. 6C are schematic diagrams of value assignment manners corresponding to the right slash pattern as shown in FIG. 6A.
Figure 6C:
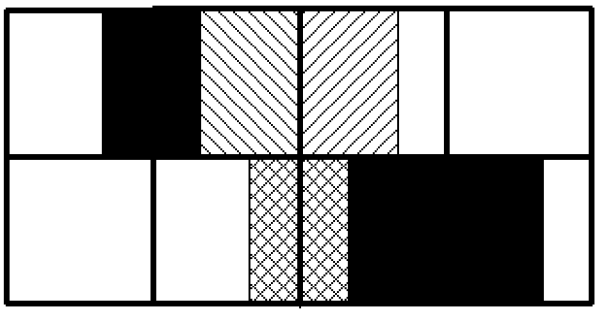

Similarly, FIG. 6A is a schematic diagram of a right slash pattern in one embodiment of the present disclosure. In the preset characteristic pattern, the middle-upper pixel and the right-lower pixel are in the bright state, and all the other pixels are in the dark state. Depending on different positions of the preset characteristic pattern, its corresponding monochromatic sub-pixel can have a gray scale value assignment manner as shown in FIG. 6B or FIG. 6C. In FIG. 6B and FIG. 6C, the three monochromatic sub-pixels in the upper row are used to for displaying of the middle-upper pixel, and the three monochromatic sub-pixels in the lower row are used to form display of the right-lower pixel. In FIG. 6B, the gray sale values of the third sub-pixel PB and the first sub-pixel PR in the lower row and the second sub-pixel PG in the upper row are set as close to the maximum value (being red, green or blue in the bright state when being displayed); the gray sale values of the second sub-pixel PG in the lower row and the third sub-pixel PB and the first sub-pixel PR in the upper row are set as close to the minimum value (being black in the dark state when being displayed). In FIG. 6C, the gray sale values of the second sub-pixel PG in the lower row and the third sub-pixel PB and the first sub-pixel PR in the upper row are set as close to the maximum value (being red, green or blue in the bright state when being displayed); the gray sale values of the third sub-pixel PB and the first sub-pixel PR in the lower row and the second sub-pixel PG in the upper row are set as close to the minimum value (being black in the dark state when being displayed).

Thus, the above rectangle sampling area can also have a size of 2 rows by 3 columns. Therefore, in the above step 100, it is possible to first sample the first and the second rows of pixels of the image using the sampling area, and then to sample the second and the third rows of pixels, and so on, wherein, when sampling the first and second rows of pixels of the image, it is possible to first sample the first, second and third columns of pixels, and then to sample the second, third and fourth columns of pixels, and so on.

Therefore, considering such an example that the above at least one preset characteristic pattern comprises only the above vertical line, the above step 101 can comprise determining whether the image within the sampling area matches the preset characteristic pattern as shown in FIG. 4A. In a case where the image within the sampling area matches the preset characteristic pattern as shown in FIG. 4A, the above step 102*a* can comprise determining the six monochromatic sub-pixels corresponding to the preset characteristic pattern as shown in FIG. 4A according the current position of the sampling area, and the above step 102*b* can comprise obtaining the gray scale values of the six monochromatic sub-pixels in the value assignment manner as shown in FIG. 4B or FIG. 4C and marking the six monochromatic sub-pixels as gray scale value being determined and unchangeable in the state marking matrix.

It can be understood that the arrangement of the gray scale values in the state marking matrix here is the same as that of the monochromatic sub-pixels in FIG. 2 and thus can have the structure as shown in FIG. 7, assuming an identifier for "gray scale value being determined and unchangeable" as "3", an identifier for "gray scale value being determined and changeable" as "2", an identifier for "being processed but gray scale value to be determined" as "1", and an identifier for "unprocessed" is "0". For ease of description, in FIG. 7, the upmost row is now assumed as the first row, and the left most column in the same row is assumed as the first column.

Referring to FIG. 7, according to the above steps 103*a* to 103*d*, the image pixels, to which the monochromatic sub-pixels masked as 0 correspond, have not been sampled; the image pixels, the gray scale values of the monochromatic sub-pixels marked as 2 or 3 have been obtained, and the image pixels, the monochromatic pixels marked as 1, are those whose gray scale values cannot be determined yet. It can be derived that, in FIG. 7, all the image pixels, to which the monochromatic sub-pixels in the first and second columns of the second row and the monochromatic sub-pixels in the first and second columns of the third row correspond, have been sampled, and not all the sampling for the image pixels, to which the monochromatic sub-pixel in the third column of the second row and the monochromatic sub-pixels in the third and fourth columns of the third row correspond, has been completed. It can be understood that, in the image as obtained in the next sampling, the sampling for the image pixels, to which the monochromatic sub-pixel in the third column of the second row and the monochromatic sub-pixels in the third and fourth columns of the third row correspond, can be completed.

Therefore, after obtaining a local image by current sampling:

for the image pixels to which the monochromatic sub-pixels in the first and second columns of the second row and the monochromatic sub-pixels in the first and second columns of the third row in FIG. 7 corresponds, processing on those monochromatic sub-pixels is skipped in a processing manner as the above step 103*b* because those monochromatic sub-pixels are marked as 2 or 3 in the state marking matrix;

for the image pixels to which the monochromatic sub-pixel in the third column of the second row and the monochromatic sub-pixels in the third and fourth columns of the third row in FIG. 7 correspond, the gray scale values of these monochromatic sub-pixels can be obtained in a processing manner as the above step 103*c* because these monochromatic sub-pixels are marked as 1 in the state marking matrix which represents that the gray scale values of these monochromatic sub-pixels can be determined now, and the markings thereof can be changed to be 2; and for the image pixels, to which the monochromatic sub-pixel in the fourth and fifth columns of the second row and the monochromatic sub-pixel in the fifth column of the third row in FIG. 7 correspond, their markings can be changed to be 1 in a processing manner as the above step 103*d* because these monochromatic sub-pixels are marked as 0 in the state marking matrix which represents that the gray scale values of these monochromatic sub-pixels cannot be determined yet for now.

After the above processing, the state marking matrix after the current sampling becomes the contents as shown in FIG. 8. It should be noted that, for the monochromatic sub-pixels at an edge position, there may be such a case that they are affected only by one sampling process. Therefore, before starting the first time of sampling, at least one monochromatic sub-pixel on an edge in the sate mark matrix can be marked as "1" representing being processed but gray scale value to be determined (such as the monochromatic sub-pixel in the first column of the fourth row in FIG. 7) to avoid such a case that the markings of these monochromatic sub-pixels are changed only once and the gray scale values cannot be obtained during the processing. Of course, those skilled in the art can determine easily such settings can be applied to which monochromatic sub-pixels at the edge position according the sampling order.

According to the above approach, it is possible to obtain the gray scale values for all the monochromatic sub-pixels in the pixel structure shown in FIG. 2 with progress of the sampling, that is, to obtain the gray scale values for all the monochromatic sub-pixels for displaying an image to be displayed in one sampling traversal process on the image to be displayed, combining special processing on preset characteristic patterns at the same time. In addition, because some monochromatic sub-pixels corresponding to the preset characteristic pattern, with gray scale values being determined and unchangeable, are marked specially in the state marking matrix, it can be ensured that the processing on these monochromatic sub-pixels will not be repeated or missed during the process and will not be changed during the subsequent process, whereby an image conversion flow integrated with particular image processing can be completed in one traversal without repetition or missing.

Further, since the monochromatic sub-pixel in an embodiment of the present disclosure can be used for displaying multiple image pixels simultaneously, the present disclosure can be applied to various types of pixel structures, and can realize a high resolution algorithm with high algorithm efficiency under the precondition of combining particular pattern processing.

Figure 9:
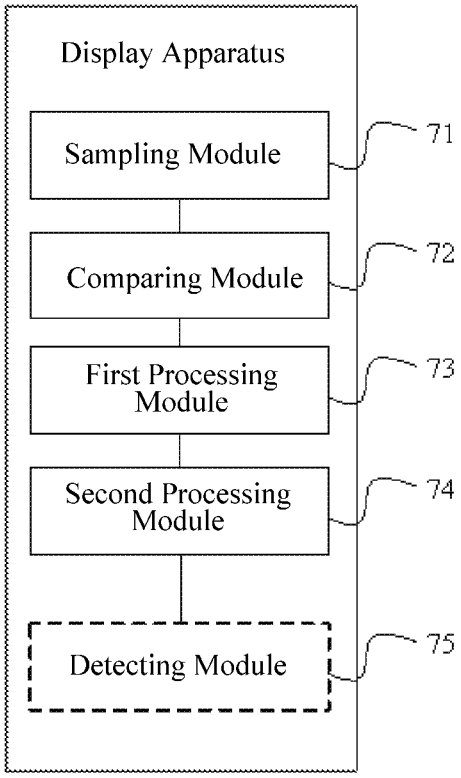
FIG. 9 is a structural block diagram of a part of structure of a display apparatus in one embodiment of the present disclosure.

Based on the same inventive concept, FIG. 9 is a structural block diagram of a part of structure of a display apparatus in one embodiment of the present disclosure. Referring to FIG. 9, the display apparatus comprises:

a sampling module 71 configured to sample an image to be displayed row by row and column by column in a predefined order by using a rectangular sampling area with a size matching at least one preset characteristic pattern;

a comparing module 72 configured to compare an image within a sampling area with each of the at least one preset characteristic pattern respectively after the sampling module 71 obtains an image within the sampling area at any position;

a first processing module 73 configured to, in a case where the comparing module 72 determines that the image within the sampling area matches any preset characteristic pattern, obtain a gray scale value for at least one monochromatic sub-pixel among multiple monochromatic sub-pixels corresponding to the sampling area in a value assignment manner corresponding to the preset characteristic pattern, and mark the at least one monochromatic sub-pixel in a state marking matrix as gray scale value being determined and unchangeable; and a second processing module 74 configured to, in a case where the comparing module 72 determines that the image within the sampling area does not match any present characteristic pattern, calculate gray scale values for multiple monochromatic sub-pixels corresponding to the sampling area according to the markings of the multiple monochromatic sub-pixels corresponding to the sampling area in the state marking matrix and the image within the sampling area, and mark the monochromatic sub-pixels in the state marking matrix as gray scale value being determined and changeable or being processed but gray scale value to be determined;

wherein all the markings in the state marking matrix correspond to all the monochromatic sub-pixels for displaying the image in a one to one manner, and in an initial state, all the markings in the state marking matrix, which correspond to all the monochromatic sub-pixels, are unprocessed.

It should be noted that the display apparatus in the present embodiment can be any product or component with a displaying function, such as a display panel, electronic paper, a cell phone, a pad computer, a television, a notebook computer, a digital photo frame, a navigator or the like. The above sampling module 71, comparing module 72, first processing module 73 and second processing module 74 can all be arranged on an array substrate of the display apparatus, or can be combined into a separate data processing circuit and arranged around the array substrate. In addition, the display apparatus in embodiments of the present disclosure can be configured to perform the step flows of the above step 100 and the steps 101 to 103 in FIG. 1, which will not be repeated here.

In one embodiment of the present disclosure, the apparatus can further comprise a detecting module 75 shown by a dashed frame in FIG. 9. The detecting module 75 is configured to detect current processing progress and/or errors that have occurred according to the markings in the state marking matrix. As can be seen, the detecting module 75 can be configured to perform the flow as described in step 104, which will not be repeated here.

Figure 10A:
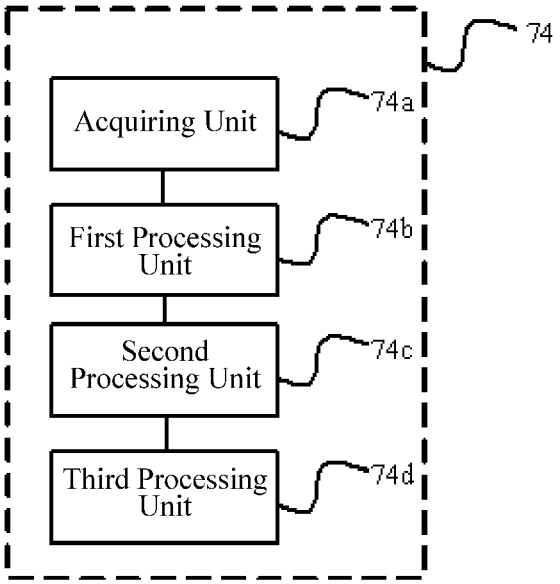
FIG. 10A and FIG. 10B are structural block diagrams of a part of structure of a display apparatus in one embodiment of the present disclosure.

In one embodiment of the present disclosure, any of the monochromatic sub-pixels can be used to form displaying of one or two pixels in the image to be displayed, and meanwhile, the second processing module 74 can comprise the following structure as shown in FIG. 10A:

an acquiring unit 74*a* configured to acquire sequentially the markings in the state marking matrix for multiple monochromatic sub-pixels corresponding to the sampling area;

a first processing unit 74*b* configured to, in a case where the acquiring unit 74*a* determines that any monochromatic sub-pixel is marked as gray scale value being determined and unchangeable or gray scale value being determined and changeable, skip processing the monochromatic sub-pixel;

a second processing unit 74*c* configured to, in a case where the acquiring unit 74*a* determines that any monochromatic sub-pixel is marked as being unprocessed, mark the monochromatic sub-pixel in the state marking matrix as being processed but gray scale value to be determined; and a third processing unit 74*d* configured to, in a case where the acquiring unit 74*a* determines that any monochromatic sub-pixel is marked as being processed but gray scale value to be determined, calculate the gray scale value for the monochromatic sub-pixel according to the image within the sampling area, and mark the monochromatic sub-pixel in the state marking matrix as gray scale value being determined and changeable;

wherein before said acquiring sequentially the markings in the state marking matrix for the multiple monochromatic sub-pixels corresponding to the sampling area, at least one monochromatic sub-pixel on an edge in the state marking matrix is marked as being processed but gray scale value to be determined.

As can be seen, the above structure can be configured to perform the flows as described in steps 103*a* to 103*d*, which will not be repeated here.

In one embodiment of the present disclosure, all the monochromatic sub-pixels for displaying are arranged with a repeating group as the smallest repeating unit, each repeating group comprising M pixel groups, and each of the M pixel groups comprising monochromatic sub-pixels, one for each color, and each repeating group corresponding to N pixels in the image to be displayed, wherein M is smaller than N, and M and N are both larger than zero. It should be noted that any one monochromatic sub-pixel is only comprised in one pixel group, rather than being shared by two pixel groups. It can be seen that one monochromatic sub-pixel in embodiments of the present disclosure can be used for displaying multiple pixels in the image simultaneously, and therefore, compared with being used only for displaying one pixel in the image, a higher display resolution can be achieved.

Figure 10B:
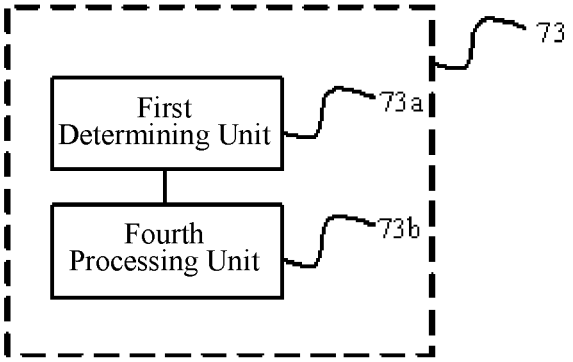

In an embodiment of the present disclosure, the above first processing module 73 can comprise the following structure as shown in FIG. 10B:

a first determining unit 73*a* configured to, in a case where the comparing module 72 determines that the image within the sampling area matches any preset characteristic pattern, determine at least one pixel group for displaying the preset characteristic pattern according to a position of the sampling area in the image; and a fourth processing unit 73*b* configured to obtain the gray scale value for at least one monochromatic sub-pixel among all the monochromatic sub-pixels in the at least one pixel group obtained by the first determining unit 73*a* in a value assignment manner corresponding to the preset characteristic pattern, and mark the at least one monochromatic sub-pixel as its gray scale value has been determined and is unchangeable in the state marking matrix.

For example, all the monochromatic sub-pixels for displaying the image comprise first sub-pixels, second sub-pixels and third sub-pixels; each repeating groups comprises two first sub-pixels, two second sub-pixels and two third sub-pixels; a first sub-pixel, a second sub-pixel and a third sub-pixel in a first pixel row of each repeating groups are arranged in sequence; a third sub-pixel, a first sub-pixel and a second sub-pixel in a second pixel row of each repeating groups are arranged in sequence; except the monochromatic sub-pixels located at an edge position, any three of adjacent first sub-pixel, second sub-pixel and third sub-pixel forms displaying of two adjacent pixels in the same row of the image.

As can be seen, all the monochromatic sub-pixels in an embodiment of the present disclosure can also have a pixel structure as shown in FIG. 2, which will not be repeated here.

In addition, same as the above, the above preset characteristic pattern comprises a vertical line pattern, a left slash pattern and a right slash pattern each occupying two adjacent upper and lower rows of pixels and three adjacent left, middle and right columns of pixels in the image;

both middle-upper pixels and the middle-lower pixels of the vertical line pattern are in a first gray scale state, all the other pixels thereof are in a second gray scale state, the first gray scale state and the second grays scale state being one of a bright state and a dark state respectively;

both left-lower pixels and middle-upper pixels of the left slash pattern are in the first gray scale state, all the other pixels thereof are in the second gray scale state; and both right-lower pixels and middle-upper pixels of the right slash pattern are in the first gray scale state, all the other pixels thereof are in the second gray scale state.

As can be seen, the preset characteristic patterns in embodiments of the present disclosure likewise comprise the preset characteristic patterns as shown in FIG. 4A, FIG. 5A and FIG. 6A, which will not be repeated here.

The specification of the present disclosure has described lots of details. However, it can be understood that embodiments of the present disclosure can be practiced without those details. In some instances, those already known methods, structures and technologies are not illustrated in detail in order not to obscure understanding of the specification of the present disclosure.

Similarly, it should be understood that, in order to simplify the present disclosure and facilitate understanding one or more inventive aspects, in the above description on exemplary embodiments of the present disclosure, features of the present disclosure are grouped into one single embodiment, figure, or description on it sometimes. However, the disclosed method should not interpret with such an intention that the present disclosure claimed to be protected require more features than that explicitly defined in each claim. More accurately, as reflected by the following claims, each inventive aspect has fewer features than all the features in each signal embodiment disclosed in the above. Therefore, the claims in accordance with specific embodiments are explicitly incorporated in to the specific embodiments, wherein every claim itself is taken as a separate embodiment of the present disclosure.

Those skilled in the art can understand that it is possible to adaptively change the modules in the devices of an embodiment and put them in one or more devices different from the embodiment. It is possible to combine modules or units or components in embodiments into one module or unit or component, and it is also possible to split them into multiple sub-modules or sub-units or sub-components. All the features disclosed in the present specification (including accompanying claims, abstract and FIGS.) and all the procedures or units of any method or device disclosed can be combined in any combination manner except that at least some of those features and/or procedures or units conflict each other. Every feature disclosed in the present specification (including accompanying claims, abstract and FIGS.)

can be replaced by a replacing feature providing the same, equivalent or similar object unless explicitly stated to the contrary.

In addition, those skilled in the art can understand that, although some embodiments described herein comprise some features rather than other features comprised in other embodiments, combination of features in different embodiments means to be covered by the scope of the present disclosure and form different embodiments. For example, in the following claims, any of the embodiments claimed to be protected can be used in any combination manner.

Embodiments for respective component of the present disclosure can be implemented in hardware, or in soft modules executed in one or more processors, or in their combination. Those skilled in the art should be understand that it is possible to use a micro-processor or a digital signal processor (DSP) to implement some or all of functions for some of all of components in the display apparatus in an embodiment of the present disclosure. The present disclosure can also be embodied as device or apparatus programs for performing part or all of the methods described herein (for example, computer programs and computer program products). Such programs implementing the present disclosure can be stored in a computer readable medium, or can have a form of one or more signals. Such signals can be downloaded for the internet websites, or be provided in a carrier signal, or be provided by any other form.

It should be noted that the above embodiments describe the present disclosure rather than limit the present disclosure and those skilled in the art can design alternative embodiments without departing from the scope of the attached claims. In the claims, none of the reference symbols put in a bracket should be interpreted as limiting of the claims. The term "comprising" does not preclude existence of elements or steps which are not listed in the claims. Words such as "a" or "an" located in front of an elements does not preclude existence of multiple such elements. The present disclosure can be implemented in a hardware containing several different elements or in a computer suitably programmed. In the unit claims with several apparatuses listed, some of those apparatuses can be embodied by the same hardware. The use of the terms "first", "second" and "third" does not mean any order. Those terms can be interpreted as names.

Finally, it should be noted that the above embodiments are only used to illustrate the technical solutions of the present disclosure rather than limit the present disclosure. Although the present disclosure is described in detail with reference to the above embodiments, those skilled in the art should understand that they can still modify the technical solutions described by the above embodiments, or equivalently replace part or all technical features. Those modifications or replacements do not make the essence of corresponding technical solutions depart from the scope of the technical solutions of embodiments of the present disclosure, and they should all be by covered by the scope of claims and specification of the present disclosure.

The present application claims the priority of Chinese Patent Application No. 201510266853.4 filed on May 22, 2015, entire content of which is incorporated as part of the present invention by reference.

What is claimed is:

1. An image display method performed on a display apparatus, comprising:

sampling an image to be displayed, by a sampling circuit, row by row and column by column in a predefined order by using a rectangular sampling area with a size matching at least one preset characteristic pattern, wherein after obtaining an image within a sampling area, the method further comprises:

comparing, by at least one processor, the image within the sampling area with each of the at least one preset characteristic pattern, respectively, to determine whether the image within the sampling area matches any of the at least one preset characteristic pattern;

in a case where the image within the sampling area matches any of the at least one preset characteristic pattern, obtaining, by the at least one processor, a gray scale value for at least one monochromatic sub-pixel among multiple monochromatic sub-pixels corresponding to the sampling area in a value assignment manner corresponding to the preset characteristic pattern, and marking, by the at least one processor, the at least one monochromatic sub-pixel in a state marking matrix as gray scale value being determined and unchangeable; and in a case where the image within the sampling area does not match any of the at least one present characteristic pattern, calculating, by the at least one processor, gray scale values for multiple monochromatic sub-pixels corresponding to the sampling area according to the markings of the multiple monochromatic sub-pixels in the state marking matrix and the image within the sampling area, and marking, by the at least one processor, the monochromatic sub-pixels in the state marking matrix as gray scale value being determined and changeable or being processed but gray scale value to be determined;

wherein all the markings in the state marking matrix correspond to all the monochromatic sub-pixels for displaying the image by the display apparatus, in a one to one manner, and in an initial state, all the markings in the state marking matrix, which correspond to all the monochromatic sub-pixels, are unprocessed.

2. The method according to claim 1, further comprising:

detecting, by a detecting circuit, current processing progress and/or errors that have occurred according to the markings in the state marking matrix.

3. The method according to claim 2, wherein any monochromatic sub-pixel is used to form displaying of one or two pixels in the image to be displayed; and said in a case where the image within the sampling area does not match any of the at least one present characteristic pattern, calculating, by the at least one processor, gray scale values for multiple monochromatic sub-pixels corresponding to the sampling area according to the markings of the multiple monochromatic sub-pixels in the state marking matrix and the image within the sampling area, and marking, by the at least one processor, the monochromatic sub-pixels with the gray scale values obtained in the state marking matrix as gray scale value being determined and changeable or marking the monochromatic sub-pixels without the gray scale values in the state marking matrix as being processed but gray scale value to be determined, comprises:

acquiring, by the at least one processor, sequentially the markings in the state marking matrix for the multiple monochromatic sub-pixels corresponding to the sampling area;

in a case where any monochromatic sub-pixel is marked as gray scale value being determined and unchangeable or gray scale value being determined and changeable, skipping, by the at least one processor, processing the monochromatic sub-pixel;

in a case where any monochromatic sub-pixel is marked as being processed but gray scale value to be determined, calculating, by the at least one processor, the gray scale value for the monochromatic sub-pixel according to the image within the sampling area, and marking, by the at least one processor, the monochromatic sub-pixel in the state marking matrix as gray scale value being determined and changeable; and in a case where any monochromatic sub-pixel is marked as being unprocessed, marking, by the at least one processor, the monochromatic sub-pixel in the state marking matrix as being processed but gray scale value to be determined;

wherein before said acquiring sequentially the markings in the state marking matrix for the multiple monochromatic sub-pixels corresponding to the sampling area, at least one monochromatic sub-pixel on an edge in the state marking matrix is marked as being processed but gray scale value to be determined.

4. The method according to claim 2, wherein all the monochromatic sub-pixels for displaying are arranged with a repeating group as a smallest repeating unit, each repeating group comprising M pixel groups, and each of the M pixel groups comprising monochromatic sub-pixels, one for each color, and each repeating group corresponding to N pixels in the image to be displayed, wherein M is smaller than N, and M and N are both larger than zero.

5. The method according to claim 2, wherein the preset characteristic pattern comprises a vertical line pattern, a left slash pattern and a right slash pattern each occupying two adjacent upper and lower rows of pixels and three adjacent left, middle and right columns of pixels in the image;

both middle-upper pixels and the middle-lower pixels of the vertical line pattern are in a first gray scale state, all the other pixels thereof are in a second gray scale state, the first gray scale state and the second grays scale state being one of a bright state and a dark state respectively;

both left-lower pixels and middle-upper pixels of the left slash pattern are in the first gray scale state, all the other pixels thereof are in the second gray scale state; and both right-lower pixels and middle-upper pixels of the right slash pattern are in the first gray scale state, all the other pixels thereof are in the second gray scale state.

6. The method according to claim 1, wherein any monochromatic sub-pixel is used to form displaying of one or two pixels in the image to be displayed; and said in a case where the image within the sampling area does not match any of the at least one present characteristic pattern, calculating, by the at least one processor, gray scale values for multiple monochromatic sub-pixels corresponding to the sampling area according to the markings of the multiple monochromatic sub-pixels in the state marking matrix and the image within the sampling area, and marking, by the at least one processor, the monochromatic sub-pixels with the gray scale values obtained in the state marking matrix as gray scale value being determined and changeable or marking the monochromatic sub-pixels without the gray scale values in the state marking matrix as being processed but gray scale value to be determined, comprises:

acquiring, by the at least one processor, sequentially the markings in the state marking matrix for the multiple monochromatic sub-pixels corresponding to the sampling area;

in a case where any monochromatic sub-pixel is marked as gray scale value being determined and unchangeable or gray scale value being determined and changeable, skipping, by the at least one processor, processing the monochromatic sub-pixel;

in a case where any monochromatic sub-pixel is marked as being processed but gray scale value to be determined, calculating, by the at least one processor, the gray scale value for the monochromatic sub-pixel according to the image within the sampling area, and marking, by the at least one processor, the monochromatic sub-pixel in the state marking matrix as gray scale value being determined and changeable; and in a case where any monochromatic sub-pixel is marked as being unprocessed, marking, by the at least one processor, the monochromatic sub-pixel in the state marking matrix as being processed but gray scale value to be determined;

wherein before said acquiring sequentially the markings in the state marking matrix for the multiple monochromatic sub-pixels corresponding to the sampling area, at least one monochromatic sub-pixel on an edge in the state marking matrix is marked, by the at least one processor, as being processed but gray scale value to be determined.

7. The method according to claim 6, wherein all the monochromatic sub-pixels for displaying are arranged with a repeating group as a smallest repeating unit, each repeating group comprising M pixel groups, and each of the M pixel groups comprising monochromatic sub-pixels, one for each color, and each repeating group corresponding to N pixels in the image to be displayed, wherein M is smaller than N, and M and N are both larger than zero.

8. The method according to claim 6, wherein the preset characteristic pattern comprises a vertical line pattern, a left slash pattern and a right slash pattern each occupying two adjacent upper and lower rows of pixels and three adjacent left, middle and right columns of pixels in the image;

both middle-upper pixels and the middle-lower pixels of the vertical line pattern are in a first gray scale state, all the other pixels thereof are in a second gray scale state, the first gray scale state and the second grays scale state being one of a bright state and a dark state respectively;

both left-lower pixels and middle-upper pixels of the left slash pattern are in the first gray scale state, all the other pixels thereof are in the second gray scale state; and both right-lower pixels and middle-upper pixels of the right slash pattern are in the first gray scale state, all the other pixels thereof are in the second gray scale state.

9. The method according to claim 1, wherein all the monochromatic sub-pixels for displaying are arranged with a repeating group as a smallest repeating unit, each repeating group comprising M pixel groups, and each of the M pixel groups comprising monochromatic sub-pixels, one for each color, and each repeating group corresponding to N pixels in the image to be displayed, wherein M is smaller than N, and M and N are both larger than zero.

10. The method according to claim 9, wherein said in a case where the image within the sampling area matches any of the at least one preset characteristic pattern, obtaining, by the at least one processor, a gray scale value for at least one monochromatic sub-pixel among multiple monochromatic sub-pixels corresponding to the sampling area in a value assignment manner corresponding to the preset characteristic pattern, and marking, by the at least one processor, the at least one monochromatic sub-pixel in a state marking matrix as gray scale value being determined and unchangeable, comprises:

determining, by the at least one processor, at least one pixel group for displaying the preset characteristic pattern according to a position of the sampling area in the image; and obtaining, by the at least one processor, a gray scale value for at least one monochromatic sub-pixel among multiple monochromatic sub-pixels within the at least one pixel group corresponding to the sampling area in a value assignment manner corresponding to the preset characteristic pattern, and marking, by the at least one processor, the at least one monochromatic sub-pixel in a state marking matrix as gray scale value being determined and unchangeable.

11. The method according to claim 10, wherein all the monochromatic sub-pixels for displaying the image comprise first sub-pixels, second sub-pixels and third sub-pixels; each repeating groups comprises two first sub-pixels, two second sub-pixels and two third sub-pixels; a first sub-pixel, a second sub-pixel and a third sub-pixel in a first pixel row of each repeating groups are arranged in sequence; a third sub-pixel, a first sub-pixel and a second sub-pixel in a second pixel row of each repeating groups are arranged in sequence; except the monochromatic sub-pixels located at an edge position, any three of adjacent first sub-pixel, second sub-pixel and third sub-pixel are used for displaying of two adjacent pixels in the same row of the image.

12. The method according to claim 9, wherein all the monochromatic sub-pixels for displaying the image comprise first sub-pixels, second sub-pixels and third sub-pixels; each repeating groups comprises two first sub-pixels, two second sub-pixels and two third sub-pixels; a first sub-pixel, a second sub-pixel and a third sub-pixel in a first pixel row of each repeating groups are arranged in sequence; a third sub-pixel, a first sub-pixel and a second sub-pixel in a second pixel row of each repeating groups are arranged in sequence; except the monochromatic sub-pixels located at an edge position, any three of adjacent first sub-pixel, second sub-pixel and third sub-pixel are used for displaying of two adjacent pixels in the same row of the image.

13. The method according to claim 1, wherein the preset characteristic pattern comprises a vertical line pattern, a left slash pattern and a right slash pattern each occupying two adjacent upper and lower rows of pixels and three adjacent left, middle and right columns of pixels in the image;

both middle-upper pixels and the middle-lower pixels of the vertical line pattern are in a first gray scale state, all the other pixels thereof are in a second gray scale state, the first gray scale state and the second grays scale state being one of a bright state and a dark state respectively;

both left-lower pixels and middle-upper pixels of the left slash pattern are in the first gray scale state, all the other pixels thereof are in the second gray scale state; and both right-lower pixels and middle-upper pixels of the right slash pattern are in the first gray scale state, all the other pixels thereof are in the second gray scale state.

14. A display apparatus comprising:

a sampling circuit configured to sample an image to be displayed row by row and column by column in a predefined order by using a rectangular sampling area with a size matching at least one preset characteristic pattern; and at least one processor configured to compare an image within a sampling area with each of the at least one preset characteristic pattern respectively after the sampling circuit obtains an image within a sampling area, to determine whether the image within the sampling area matches any of the at least one preset characteristic pattern;

the at least one processor is further configured to, in a case it is determined that the image within the sampling area matches any of the at least one preset characteristic pattern, obtain a gray scale value for at least one monochromatic sub-pixel among multiple monochromatic sub-pixels corresponding to the sampling area in a value assignment manner corresponding to the preset characteristic pattern, and mark the at least one monochromatic sub-pixel in a state marking matrix as gray scale value being determined and unchangeable; and is further configured to, in a case where it is determined that the image within the sampling area does not match any of the at least one present characteristic pattern, calculate gray scale values for multiple monochromatic sub-pixels corresponding to the sampling area according to the markings of the multiple monochromatic sub-pixels in the state marking matrix and the image within the sampling area, and mark the monochromatic sub-pixels in the state marking matrix as gray scale value being determined and changeable or being processed but gray scale value to be determined;

wherein all the markings in the state marking matrix correspond to all the monochromatic sub-pixels for displaying the image in a one to one manner, and in an initial state, all the markings in the state marking matrix, which correspond to all the monochromatic sub-pixels, are unprocessed.

15. The apparatus according to claim 14, further comprising:

a detecting circuit configured to detect current processing progress and/or errors that have occurred according to the markings in the state marking matrix.

16. The apparatus according to claim 14, wherein any monochromatic sub-pixel is used to form displaying of one or two pixels in the image to be displayed, and the at least one processor is configured to:

acquire sequentially the markings in the state marking matrix for multiple monochromatic sub-pixels corresponding to the sampling area;

in a case where it is determined that any monochromatic sub-pixel is marked as gray scale value being determined and unchangeable or gray scale value being determined and changeable, skip processing the monochromatic sub-pixel;

in a case where it is determined that any monochromatic sub-pixel is marked as being unprocessed, mark the monochromatic sub-pixel in the state marking matrix as being processed but gray scale value to be determined; and in a case where it is determined that any monochromatic sub-pixel is marked as being processed but gray scale value to be determined, calculate the gray scale value for the monochromatic sub-pixel according to the image within the sampling area, and mark the monochromatic sub-pixel in the state marking matrix as gray scale value being determined and changeable;

wherein before said acquiring sequentially the markings in the state marking matrix for the multiple monochromatic sub-pixels corresponding to the sampling area, at least one monochromatic sub-pixel on an edge in the state marking matrix is marked as being processed but gray scale value to be determined.

17. The apparatus according to claim 14, wherein all the monochromatic sub-pixels for displaying are arranged with a repeating group as a smallest repeating unit, each repeating group comprising M pixel groups, and each of the M pixel groups comprising monochromatic sub-pixels, one for each color, and each repeating group corresponding to N pixels in the image to be displayed, wherein M is smaller than N, and M and N are both larger than zero.

18. The apparatus according to claim 17, wherein the at least one processor is configured to:

in a case where it is determined that the image within the sampling area matches any of the at least one preset characteristic pattern, determine at least one pixel group for displaying the preset characteristic pattern according to a position of the sampling area in the image; and obtain a gray scale value for at least one monochromatic sub-pixel among all the monochromatic sub-pixels in at least one pixel group obtained in a value assignment manner corresponding to the preset characteristic pattern, and mark the at least one monochromatic sub-pixel in a state marking matrix as gray scale value being determined and unchangeable.

19. The apparatus according to claim 17, wherein all the monochromatic sub-pixels for displaying the image comprise first sub-pixels, second sub-pixels and third sub-pixels; each repeating groups comprises two first sub-pixels, two second sub-pixels and two third sub-pixels; a first sub-pixel, a second sub-pixel and a third sub-pixel in a first pixel row of each repeating groups are arranged in sequence; a third sub-pixel, a first sub-pixel and a second sub-pixel in a second pixel row of each repeating groups are arranged in sequence; except the monochromatic sub-pixels located at an edge position, any three of adjacent first sub-pixel, second sub-pixel and third sub-pixel forms displaying of two adjacent pixels in the same row of the image.

20. The apparatus according to claim 14, wherein the preset characteristic pattern comprises a vertical line pattern, a left slash pattern and a right slash pattern each occupying two adjacent upper and lower rows of pixels and three adjacent left, middle and right columns of pixels in the image;

both middle-upper pixels and middle-lower pixels of the vertical line pattern are in a first gray scale state, all the other pixels thereof are in a second gray scale state, the first gray scale state and the second grays scale state being one of a bright state and a dark state respectively;

both left-lower pixels and middle-upper pixels of the left slash pattern are in the first gray scale state, all the other pixels thereof are in the second gray scale state; and both right-lower pixels and middle-upper pixels of the right slash pattern are in the first gray scale state, all the other pixels thereof are in the second gray scale state.

* * * * *